US006044526A

United States Patent [19]

Putney

[11] Patent Number: 6,044,526

[45] Date of Patent: Apr. 4, 2000

[54] CLASP FOR HOLDING FABRIC OR OTHER SHEET-LIKE MATERIAL

[76] Inventor: Marilyn Putney, P.O. Box 2588, Wichita Falls, Tex. 76307

[21] Appl. No.: 09/266,683

[22] Filed: Mar. 11, 1999

Related U.S. Application Data

[60] Provisional application No. 60/105,952, Oct. 28, 1998.

[51] Int. Cl.[7] ..... A47C 21/00; B65D 63/00

[52] U.S. Cl. ..... 24/72.5; 24/17 B; 24/17 AP; 24/301; 24/716

[58] Field of Search ..... 24/72.5, 300, 301, 24/66.5, 66.11, 66.2, 15, 17 B, 17 AP, 716, 3.12

[56] References Cited

U.S. PATENT DOCUMENTS

| | | | |
|---|---|---|---|
| 488,088 | 12/1892 | Pettibone . | |
| 1,545,501 | 7/1925 | Laird | 24/72.5 |
| 1,602,305 | 10/1926 | Helm . | |
| 1,829,613 | 10/1931 | Sato | 24/17 AP |
| 1,945,932 | 2/1934 | Caley | 24/17 AP |
| 2,050,189 | 8/1936 | Le Page | 24/245 |
| 2,314,779 | 3/1943 | Fuhrmann | 24/17 AP |
| 2,648,879 | 8/1953 | Patterson | 24/17 B |
| 2,983,980 | 5/1961 | Hamel | 24/716 |
| 3,092,848 | 6/1963 | Gronvold | 5/320 |
| 4,660,240 | 4/1987 | Hutton et al. | 5/451 |
| 5,081,746 | 1/1992 | Czwartacki | 24/17 B |
| 5,117,537 | 6/1992 | Hunter et al. | 24/72.5 |
| 5,161,276 | 11/1992 | Hutton et al. | 24/72.5 |
| 5,497,537 | 3/1996 | Robinson et al. | 24/716 |
| 5,655,271 | 8/1997 | Maxwell-Trumble et al. | 24/459 |
| 5,715,578 | 2/1998 | Knudson | 24/17 B |
| 5,893,456 | 4/1999 | Bosmans | 24/17 AP |

FOREIGN PATENT DOCUMENTS

| | | | |
|---|---|---|---|
| 0796222 | 4/1936 | France | 24/17 AP |
| 0020300 | of 1906 | United Kingdom | 24/72.5 |

*Primary Examiner*—Victor N. Sakran
*Attorney, Agent, or Firm*—Smith & Danamraj, P.C.

[57] ABSTRACT

A fastening clasp for holding fabric or other sheet-like material in a given position. The fastening clasp includes a flexible sleeve having a first end and a second end. A ring is attached to the first end of the flexible sleeve. A flexible, transverse tab is attached to the second end of the flexible sleeve. A piece of the fabric is positioned directly over the ring while the tab is inserted within the ring. The tab and fabric are both held in place by the stiffness of the tab's perimeter. The sleeve gathers and holds the fabric in the desired position.

6 Claims, 2 Drawing Sheets

CLASP FOR HOLDING FABRIC OR OTHER SHEET-LIKE MATERIAL

This utility patent application claims the priority date of Provisional Patent Application Ser. No. 60/105,952 filed Oct. 28, 1998 and is hereby incorporated by reference.

BACKGROUND OF THE INVENTION

1. Technical Field of the Invention

This invention relates to mechanical fastening devices and, more particularly, to a clasp for holding fabric or other sheet-like material in a given position.

2. Description of Related Art

Existing clasps for holding fabric are limited in their utility. Clasps for holding clothing in a given position, for example, must either extend completely around the portion of clothing to be held, or must punch a hole in the clothing fabric. For example, if it is desired to hold the sleeve of a tee shirt in a raised position near the shoulder, an existing clasp would have to extend through the neck hole of the tee shirt and around the raised sleeve, or alternatively, a hole would have to be punched in the sleeve at the position where it is desired to hold the sleeve. In addition, some existing clasps must be attached to another object in order to secure the fabric in place. For example, suspenders are used to hold pants in a specific position. However, suspenders usually run across a person's shoulders and attached to the backside and front side of the pants. It would be desirable to have a simple device which holds fabric in place without having to secure the fabric to another object or creating a hole in the fabric.

Although there are no known prior art teachings of a solution to the aforementioned deficiency and shortcoming such as that disclosed herein, prior art references that discuss subject matter that bears some relation to matters discussed herein are U.S. Pat. No. 557,456 to Utter (Utter), U.S. Pat. No. 2,050,189 to Le Page (Le Page), U.S. Pat. No. 4,660,240 to Hutton et al. (Hutton), and U.S. Pat. No. 5,117,537 to Hunter et al. (Hunter).

Utter discloses a clamp for securely fastening bedclothes in place upon a bed. The clamp includes a plate having a projecting rim on one end and a slot on another end. The clamp also includes a loop wide enough to fit snugly around the body of a knob located beneath the projecting rim. The loop diverges enough to permit the loop to pass freely over the top of the knob with several thicknesses of bed clothing upon it. The plate is attached to a strap which is connected to the bed. Although Utter is utilized to hold a bed sheet in a specific position, Utter does not teach or suggest utilizing the clamp to retain the bed sheet in place without securing the clamp to another fixed object. Utter requires that the strap be attached to the bed to hold the bed sheet in place.

Le Page discloses a fastening device for use as a garment supporter. The fastening device includes two members, a male member and a female member. The male member has a long shank with an upper end attached to a supported strap. The male member also includes a head which passes through an interlocking opening in the female member. The opening is of such size to permit the head of the male member to pass through along with a portion of a fabric garment. Le Page, in a similar fashion to Utter, utilizes a device which retains the fabric in place by attaching the fabric to the strap attached to another object. Le Page does not teach or suggest utilizing a fastening device which is secured to another object.

Hutton discloses a bed sheet attachment device for use in combination with a waterbed having a fluid-filled mattress.

The device includes a two-part fastener for gripping the sheets of a waterbed. The fastener is connected by an elastic strap to the interior of a bed frame surrounding the mattress. The fastener includes a plate defining a slot having a larger portion for receiving a stud having a neck on one end tapering to a narrow portion on the other end. The plate is placed beneath the sheet and the stud is pushed down through the enlarged portion of the slot from above the sheet, with the sheet being forced into the slot. The stud is then slid into the narrow portion of the slot to grip the sheet. However, Hutton does not teach or suggest an attachment device which secures the fabric in place without securing the attachment device to the bed.

Hunter discloses a clip device removably secured to a portion of a sheet of flexible material. The clip device includes a sheet-engaging portion having an integral tongue which projects forwardly from the device's rear portion and which can be deflected from the general plane of the device. The sheet-engaging portion also includes a peripheral frame member which extends forwardly from the rear portion of the device, and a front end with an inner edge that lies adjacent the front end of the undeflected tongue. The device has an open position in which the tongue is downwardly deflected away from a first side of the frame to provide a gap for insertion of the portion of the sheet of flexible material. The device also has a locked configuration in which the tongue is manipulated through the frame member to the other side of the frame member so that the front edge of the tongue lies in close proximate to the frame front end. The clip then frictionally secures the sheet material between the front edge of the tongue and the frame. Hunter does not teach or suggest a clip device which holds fabric in place without any attachment to another object. Hunter merely discloses utilizing a fastener as a device for securing fabric to another object.

Review of each of the foregoing references reveals no disclosure or suggestion of an apparatus as that described and claimed herein. Thus, it would be a distinct advantage to have an apparatus which holds fabric in a desired position without making a hole in the fabric and without the clasp having to extend around the entire piece of fabric. In addition, a clasp is needed which does not require attachment to another object to secure the fabric in place. It is an object of the present invention to provide such an apparatus.

SUMMARY OF THE INVENTION

In one aspect, the present invention is a fastening clasp for holding fabric in a desired position. The fastening clasp includes a flexible sleeve having a first end and a second end. The clasp also includes a tab attached to the first end of the flexible sleeve and means attached to the second end for receiving and holding the tab. When the tab is inserted with a portion of the fabric into the receiving and holding means, the flexible sleeve holds the fabric in the desired position.

In another aspect, the present invention is a method of holding fabric in a desired position. The method starts by forming a flexible sleeve with a first end and a second end. Next, a stiff ring is attached to the first end and a flexible, transverse tab is attached to the second end. The sleeve is then bent so that the tab is in proximity to the ring. A portion of the fabric is then positioned across the ring. Next, the tab is inserted through the ring, which allows the flexible sleeve to hold the fabric in the desired position.

In still another aspect, the present invention is a fastening clasp for holding fabric in a desired position. The fastening clasp includes a flexible sleeve having a first end and a second end. The fastening clasp also includes a flexible, transverse tab attached to the first end of the flexible sleeve and a stiff ring attached to the second end of the flexible sleeve. The ring has an opening for receiving the tab. When the tab and a portion of the fabric is inserted within the ring, the flexible sleeve holds the fabric in the desired position.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
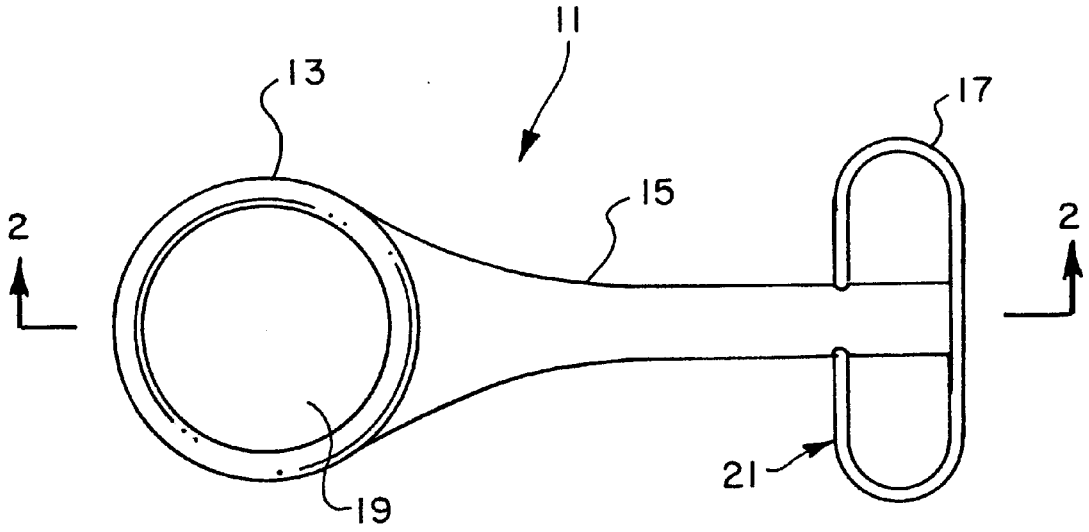
FIG. 1 is a top plan view of the preferred embodiment of the clasp of the present invention.

The present invention is a clasp for holding fabric or other sheet-like material in a given position. FIG. 1 is a top plan view of the preferred embodiment of a clasp 11 according to the teachings of the present invention. The clasp includes a ring 13, a flexible sleeve 15, and a tab 17. The ring is preferably constructed of a stiff plastic material, although any rigid material may be used. The flexible sleeve may also be constructed of any flexible material, however plastic is the preferred material. The ring is attached to one end of the flexible sleeve. The ring may be any shape providing an opening 19. On the opposite end of the flexible sleeve is the transverse, flexible tab 17, preferably constructed of plastic. The tab is shown having a perimeter 21 which is thicker than the interior portion of the tab to provide additional stiffness to the tab. Although the clasp has been described as being preferably constructed of plastic, other materials with similar flexibility may also be utilized. In addition, the preferred embodiment is described as a clasp for holding fabric although other sheet-like materials may also be held by the present invention.

Figure 2:
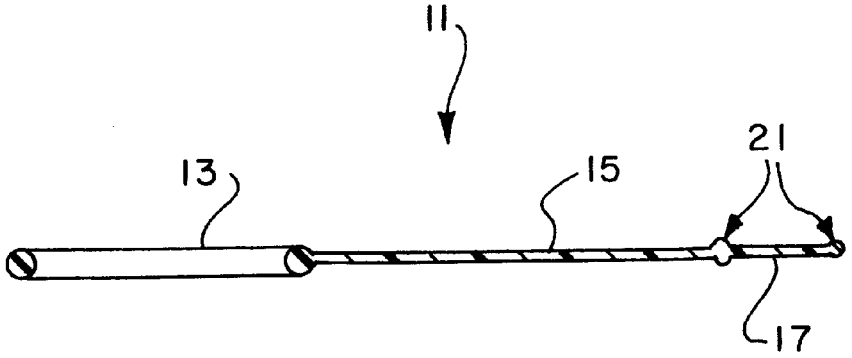
FIG. 2 is a side cross-sectional view of the clasp along the line 2—2.

FIG. 2 is a side cross-sectional view of the clasp along the line 2—2.

Figure 3:
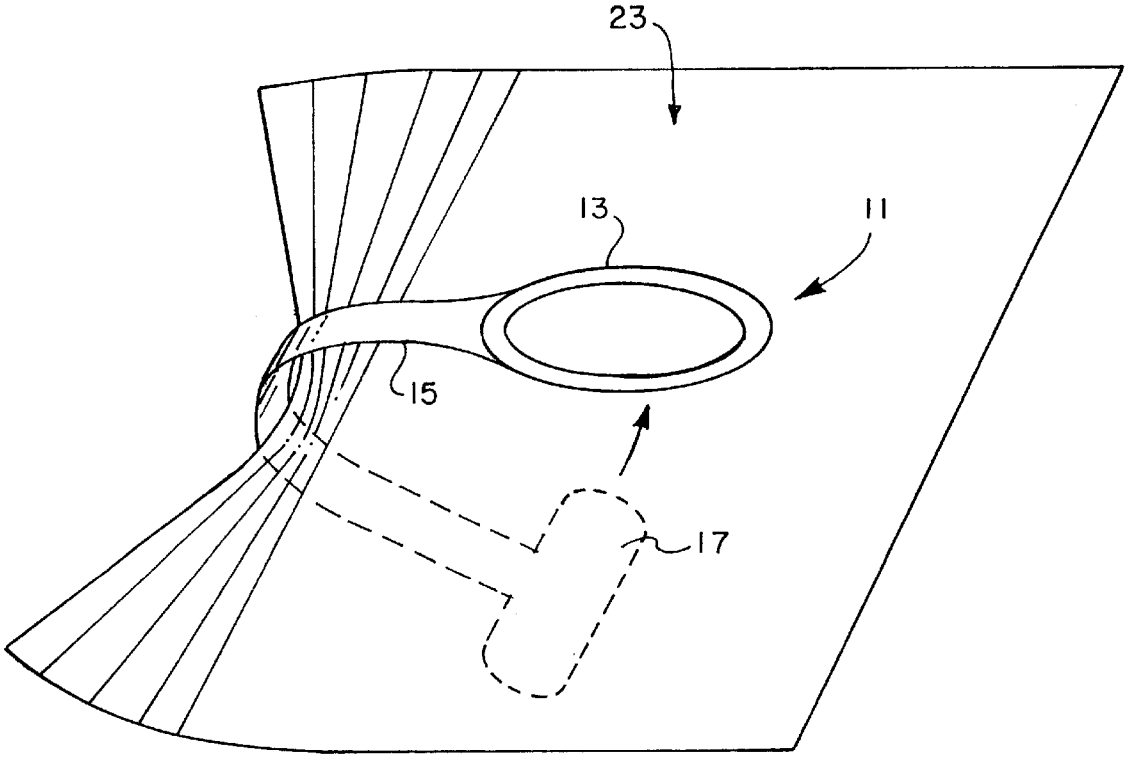
FIG. 3 is a perspective view of the clasp in a flexed position so that the ring of the clasp is directly over the tab, and a piece of fabric is located between the ring and the tab.

FIG. 3 is a perspective view of the clasp 11 in a flexed position so that the ring 13 of the clasp is directly over the tab 17, and a piece of fabric 23 is located between the ring and the tab.

Figure 4:
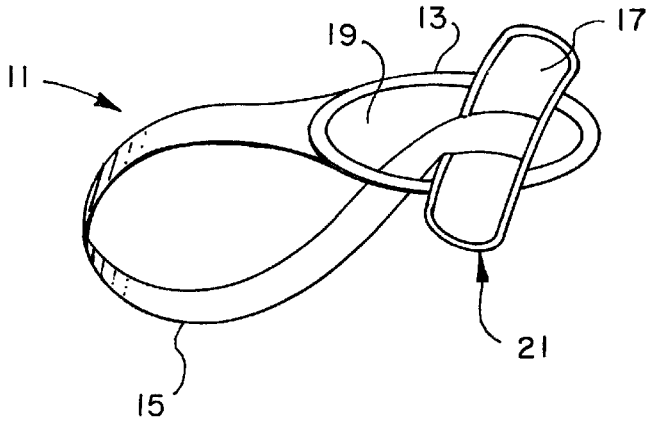
FIG. 4 is a perspective view of the clasp in a closed position, and without the fabric.

FIG. 4 is a perspective view of the clasp 11 in a closed position, and without the fabric 23 according to the teachings of the present invention. As illustrated in FIG. 4, the tab 17 is pushed through the opening 19 of the ring 13. When fabric is being held, a portion of the fabric is pushed through the ring along with the tab. The stiffness of the tab holds both the tab and the fabric in place.

Referring to FIGS. 1–4, the operation of the clasp 11 will now be explained. The clasp is used to hold the fabric 23 in a desired position. The ring is positioned over the fabric. The tab is placed on an opposite side of the fabric. The tab is inserted, with a portion of the fabric, through the opening. The transverse shape of the tab enables the tab to remain in place within the ring. Additionally, the perimeter 21 of the tab provides additional stiffness to the tab, which prevents the tab from pulling out of the ring due to the spring tension created by flexing the sleeve 15. With the tab inserted within the ring, the sleeve encompasses a portion of the fabric, which holds the fabric in a desired position.

The clasp 11 provides many advantages over the prior art. The clasp does not require creating a hole in the fabric to hold the fabric in place. Some prior art devices required that a hole be created to secure a fastening device to the fabric. The clasp also does not need to be affixed to another object to perform the function of holding the fabric in place. In many prior art devices discussed earlier, the fastening devices had to be connected to some object to hold the fabric in place. The clasp provides a simple, yet effective way of gathering the fabric with the sleeve. In addition, the clasp is not limited in its location, such as in prior art devices which used the arm holes and neck holes of a shirt in order to hold the fabric in place.

It is thus believed that the operation and construction of the present invention will be apparent from the foregoing description. While the apparatus and method shown and described has been characterized as being preferred, it will be readily apparent that various changes and modifications could be made therein without departing from the scope of the invention as defined in the following claims.

What is claimed is:

1. A fastening clasp for holding fabric in a desired position, the fastening clasp comprising:

a flexible sleeve having a first end and a second end;

a tab attached to the first end of the flexible sleeve; and means attached to the second end for receiving and holding the tab, the tab being inserted with a portion of the fabric into the receiving and holding means at a point located on an interior portion of the fabric, whereby the flexible sleeve gathers and retains a collected portion of the fabric at the interior point in a desired fixed position without attaching said clasp to another object.

2. The fastening clasp of claim 1 wherein the means for receiving and holding the tab is a ring having an opening for receiving the tab.

3. The fastening clasp of claim 2 wherein the tab is a flexible transverse tab with a stiffness sufficient to hold the tab in place when the tab is pushed through the ring.

4. The fastening clasp of claim 3 wherein the tab includes a perimeter portion and an interior portion of the tab, the perimeter portion having a thickness greater than the interior portion, the perimeter portion providing additionally stiffness to the tab.

5. A method of holding fabric in a desired position, said method comprising the steps of:

forming a flexible sleeve, said sleeve having a first end and a second end;

attaching a stiff ring to the first end;

attaching a flexible, transverse tab to the second end;

bending the sleeve so that the tab is in proximity to the ring;

positioning a portion of the fabric between the ring and the tab; and inserting the tab and fabric through the ring at a point located on an interior portion of the fabric, thereby allowing the flexible sleeve to gather and retain a collection portion of the fabric at the interior point in a desired fixed position without attaching said clasp to another object.

6. A fastening clasp for holding fabric in a desired position, the fastening clasp comprising:

a flexible sleeve having a first end and a second end;

a flexible, transverse tab attached to the first end of the flexible sleeve; and a stiff ring attached to the second end of the flexible sleeve, the ring having an opening for receiving the tab;

whereby the fabric is held in the desired position by inserting the tab with a portion of the fabric through the ring at a point located on an interior portion of the fabric, the flexible sleeve gathering and retaining a collected portion of the material at the interior point in a desired fixed position without attaching said clasp to another object.

* * * * *